United States Patent [19]

Goldman

[11] Patent Number: 4,968,181

[45] Date of Patent: Nov. 6, 1990

[54] SHOCK ABSORBER AND METHOD FOR OFFSHORE JACK-UP RIGS

[76] Inventor: Jerome L. Goldman, 935 Gravier St., Ste. 2100, New Orleans, La. 70112

[21] Appl. No.: 334,690

[22] Filed: Apr. 7, 1989

[51] Int. Cl.[5] ..... E02B 17/00

[52] U.S. Cl. ..... 405/211; 405/224

[58] Field of Search ..... 405/195, 211, 212, 214, 405/215, 224; 248/599, 600

[56] References Cited

U.S. PATENT DOCUMENTS

| | | | |
|---|---|---|---|
| 3,695,046 | 10/1972 | Torr et al. | 405/214 |
| 4,195,950 | 4/1980 | Goldman | 405/195 |
| 4,351,259 | 9/1982 | Loire | 405/212 X |
| 4,472,084 | 9/1984 | Boon | 405/211 |

*Primary Examiner*—David H. Corbin
*Attorney, Agent, or Firm*—Keaty & Keaty

[57] ABSTRACT

A new and improved shock absorber mechanism and method for use on the leg structure of a jack-up offshore drilling rig is disclosed. The shock absorbing mechanism is designed to be mounted on the bottom of each existing leg of a drilling rig and comprises a pointed piston member which is positioned on the bottom of the leg structure, wherein the piston member projects downward through the can/footing of the rig leg and is held in place by a resilient tension member which is designed to absorb shock forces during vertical/axial impact of the leg structure when contact is made with the ocean floor.

25 Claims, 3 Drawing Sheets

SHOCK ABSORBER AND METHOD FOR OFFSHORE JACK-UP RIGS

BACKGROUND OF THE INVENTION

1. Field of the Invention

This invention relates to offshore drilling rigs, and more particularly, to an improved shock absorber mechanism and method for use on the existing leg structure of offshore jack-up rigs.

2. General Background and Prior Art

In common oilfield procedures, offshore jack-up drilling rigs are often moved from one drilling and production location on the ocean floor to another location. Inherent to being moved, the legs of the drilling rigs encounter varying degrees of shock due to their being raised from and lowered onto the ocean floor. As the rigs are moved, their legs are lowered to and raised from the ocean floor while under the influence of the ocean environment, such as heave, roll, pitch and the like. For example, when a site has been chosen for the drilling rig, the legs of the rig are lowered into place onto the ocean floor. As the legs are being lowered, the forces acting upon the rig, i.e., heave, wave, pitch, roll, etc., cause the legs to rock, sway, pitch, and bob up and down, sometimes contacting the ocean floor at the base of the legs. The resulting shock to the legs of the rigs as they make contact with the ocean floor, have, in some cases, been severe and in many instances resulted in damage, and at times destruction, to the leg structure and the mechanisms for elevating and lowering the legs. Accordingly, such activities are undertaken only during relatively calm seas. In turn, the waiting time, for calm seas, can increase the costs associated with the rig operation.

There are shock absorber devices which attempt to overcome the problems of excessive shock forces to the legs when positioning the rigs. Some of the known solutions provide for compression members which absorb the shock due to impact on the ocean floor. These systems, however, can only be used in relatively calm waters and are complex structures which are not readily accessible for repairs and maintenance. These compression devices are costly and require that a large compression surface area be provided for absorption of high impact.

Further, one device in particular, which is currently being used in the industry, consists of a long lightweight skirt which is fixed around the periphery of the drilling rig, extending from the top of the platform into a depth below the bottom of the platform. Within the housing of the skirt are located air jets, which are activated when the platform is being raised or lowered. As the legs of the rig are lowered into place, the air jets draw the ocean water up into the skirt to attempt to maintain a level position on the water surface, inhibiting swaying, bobbing and the like. However, this device also is only effective in relatively calm water conditions, and further, from its positioning on the periphery of the platform, the skirt itself is exposed to damage from approaching vessels or floating objects, i.e., supply barges or floating debris. While reducing roll and pitch, it does very little to reduce vertical heave, the major cause of impact forces.

Still, other shock absorbing devices for offshore structures address problems associated with the forces caused by waves, wind, and ocean currents. However, these devices are designed for use after an offshore structure has been anchored onto the ocean floor. They do not relieve the problems of vertical impact when the structure is being raised or lowered from its anchored position. The legs structure and its mechanism for elevating and lowering the platform is not protected from the vertical impact forces.

It is therefore an object of the present invention to provide a system of absorbing shock to the legs of an offshore rig while the legs are being positioned at a pre-determined location.

It is an object of the present invention to provide a resilient shock absorbing system which is flexible enough to substantially counteract damaging forces acting on the legs of an offshore rig caused by their impact with an ocean floor.

It is a further object of the present invention to provide a simple shock absorbing device, which is more over adapted for quick operation and maintenance, and which can be used in rough ocean conditions.

These and other objects of the invention will be more apparent from the following description of the present invention.

SUMMARY OF THE INVENTION

The present invention is directed to a new and improved resilient shock absorber mechanism which is mounted on the leg structure of an offshore jack-up drilling rig to accommodate the vertical impact to the leg structure imposed by heave, wave, pitch and roll. In the preferred embodiment, the shock absorbing mechanism is mounted to the base of the leg structure and provides a piston member which projects downward through the base in a sliding vertical manner. The piston is held in place by resilient tension members, such as nylon chords. As the platform is lowered, it sways, rocks or bobs up and down, and the piston makes initial contact with the ocean floor. All vertical shock from this contact is absorbed into the nylon chords, such that no harsh forces are transferred to the leg structure.

The piston member is further designed to limit any horizontal forces associated with contact on the ocean floor. The piston member is narrow and will cut through the ocean floor creating a soft surface for contact when the main leg structure rests onto the ocean floor. Still, any vertical forces will be absorbed by the nylon chords.

Further, the nylon chords are easily accessible and can be readily changed or added to. And such nylon chords are considerably less expensive than the compression member required by other shock absorbing devices.

DETAILED DESCRIPTION OF THE PREFERRED EMBODIMENT

Figure 1:
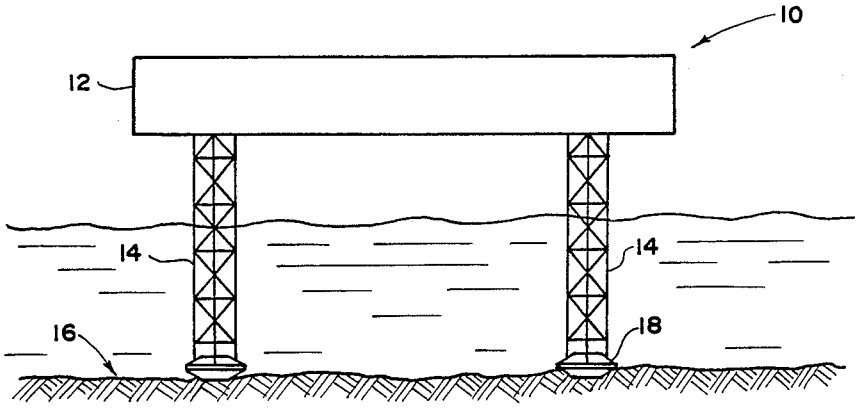
FIG. 1 is an elevational view of an offshore drilling rig structure showing the applicant's shock absorbing mechanism mounted on the bottom of the existing leg structure.

Referring now to the drawings in more detail, an offshore jack-up drilling rig is generally designated by numeral 10. As shown in FIG. 1, the structure comprises a platform 12 for supporting drilling or production operations at sea, the platform 12 being mounted on a plurality of leg elements 14 which support the platform 12 above the water surface, while resting on the bottom of an ocean floor 16.

Only two legs 14 can be seen in FIG. 1, although there are usually three or four legs supporting the platform 12.

Seated on the lowermost portion of leg 14, and fixedly attached to each leg 14, is a can or footing 18 which is designed to add stability and support to the leg structure 14.

Figure 2:
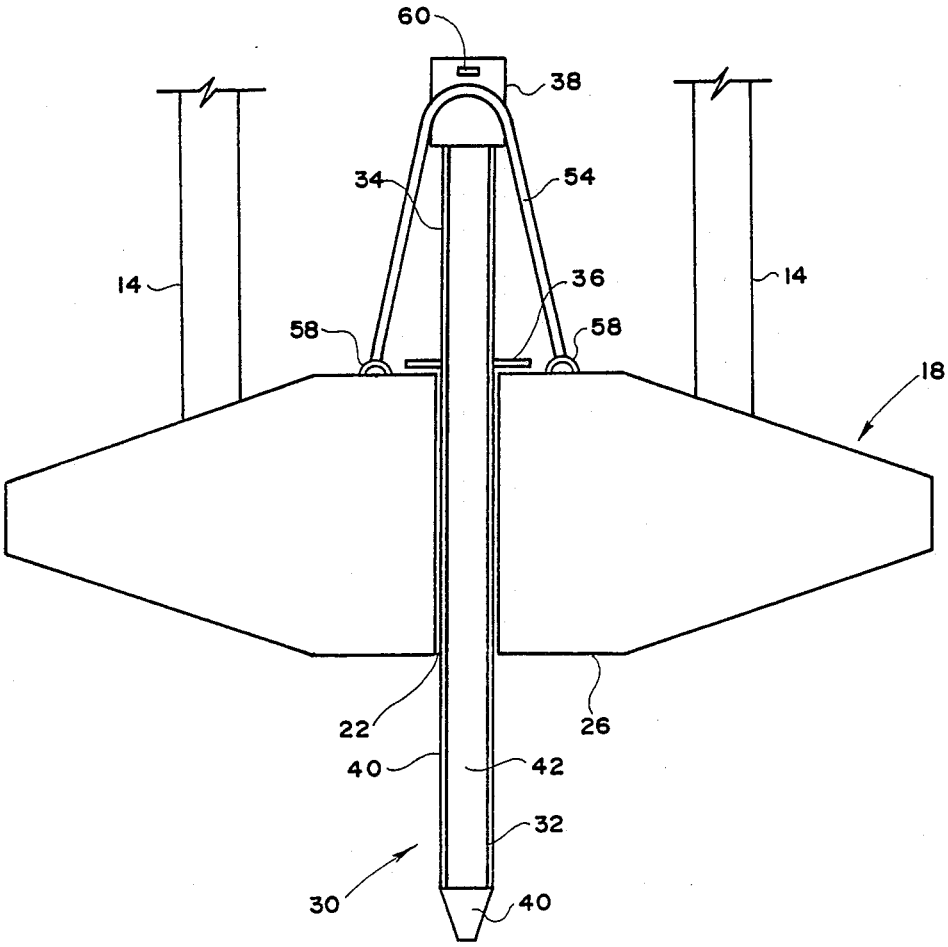
FIG. 2 is a cross-sectional view of a first embodiment of the shock absorbing mechanism of the present invention mounted on the can structure of a leg of a drilling rig.

Operatively associated with each leg structure 14 is improved shock absorbing device 20 which is better illustrated in FIG. 2.

The footing 18 may be solid, partially solid or hollow web construction, as desired, and has a generally circular horizontal cross-section and polygonal vertical cross-section, although the particular shape of the footing can be varied.

Formed in the center of each footing 18 is a central opening 22 which extends through the width of the footing 18 from the top surface 24 to the bottom surface 26 thereof. The opening 22 receives, in a limited sliding vertical relationship, a piston member 30 which comprises an elongated cylindrical body 32 having an outside diameter slightly smaller than the interior diameter of the opening 22.

Carried by an upper portion 34 of piston body 32 is a ring shaped annular stopper plate 36 fixedly attached, such as by welding and the like, in circumferential relationship to the exterior of the piston body 32 a distance from its piston head 38. The stopper plate 36 is attached in substantially perpendicular relationship to the piston body 32 and has its annular dimensions at least slightly greater than the interior diameter of the opening 22, so as to limit vertical sliding movement of the piston member 30 within the opening 22.

The piston body 32 may be formed solid or partially solid, with an interior chamber 42 filled with cement or other high density material, the purpose of which will be explained hereinafter.

The bottom of the piston body 32 carries frustoconically shaped tip 40, fixedly attached at its widest part to the body 32 and having its narrowest part extending downwardly, so as to facilitate at least partial embedment of a lower part 44 of the piston body 32. The tip 40 loosens and softens the soil around the area of its penetration during its embedment which is further facilitated by the weight of the piston body applying a downwardly directed force on the piston tip 40. The soil around the area of embedment of the lower portion 44 becomes loosened and softened, further reducing the shock on the legs during a vertical impact when the legs are lowered to the ocean floor and allowing the legs to assume their position which to a great extent is dictated by the natural conditions of the location wherein the legs 14 are placed.

Figure 3:
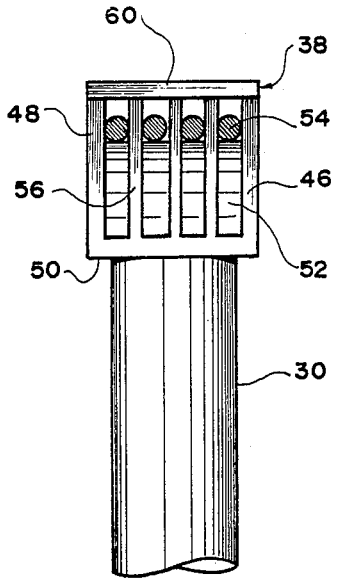
FIG. 3 is a detailed cross-sectional view of the head of the piston member of the applicant's shock absorbing mechanism.
Figure 4:
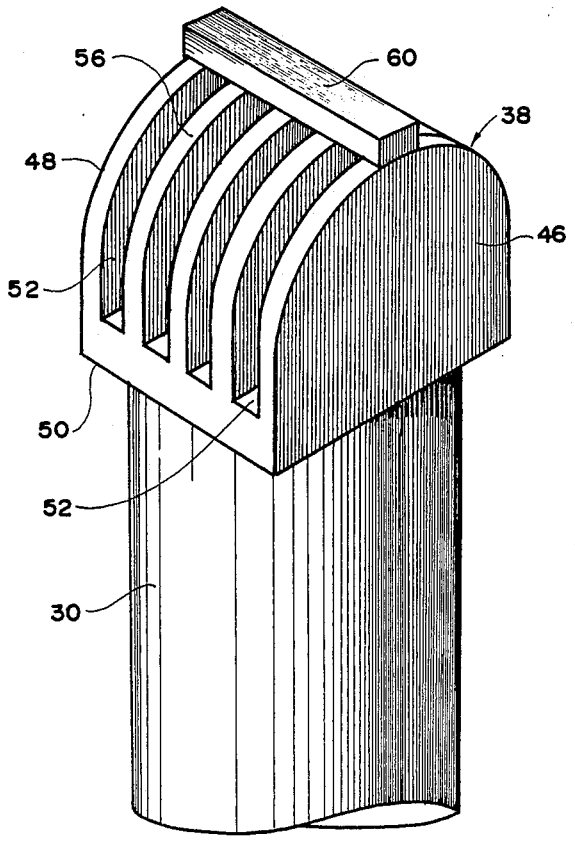
FIG. 4 is a perspective detail view of the piston head of the shock absorbing mechanism.
Figure 5:
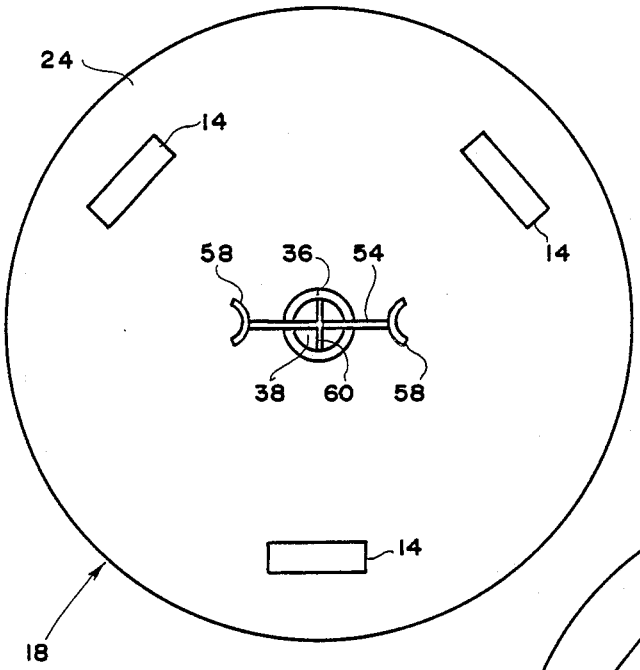
FIG. 5 is a top view of the shock absorbing mechanism of the present invention mounted on the can structure of a leg of a drilling rig.

The piston head 38 in accordance with the present invention is better illustrated in FIGS. 3 and 4. As seen in the drawings, the piston head 38 is formed substantially solid having side walls 46, 48 and bottom 50 which is fixedly attached, such as by welding or the like, to the top of the piston body 32. A plurality of inverted U-shaped grooves 52 are formed in the body of the piston head 38 extending from one end, over the top and to the opposite end thereof. The grooves may be one or more in number and their width would be sufficient to receive at least one flexible resilient tension member 54 therein.

The grooves 52, as illustrated in FIGS. 3 and 4, are formed in substantially parallel relationship to each other, divided by separation plates 56, allowing each of the tension members 54 to move in its own designated groove 52.

If desired, the piston head may be formed with one groove 52 to receive one tension cable 54 therein. In that case, the tension will not be equally distributed between a number of cables but will be applied only to one tension number 54.

The flexible tension member 54 can be an elongated nylon chord, one end of which is fixedly attached to the top surface 24 of the footing 18 by a ring or staple 58 and on its other end by a ring or staple 58 at diametrically opposite side in relation to the opening 22 or to the stopper plate 36. The flexible member 54 is stretched and threaded through the groove 52 formed in the piston head 38. In order to prevent disengagement of the flexible members 54 from their engagement within the grooves 52 a retaining bar 60 is provided, stretching between the side walls 46 and 48 of the piston head 38.

In the absence of the retaining bar 60, the flexible tension member 54 may disengage itself from its position within the groove during downward movement of the piston 30 during lowering of the legs 14 to the ocean floor 16.

Figure 6:
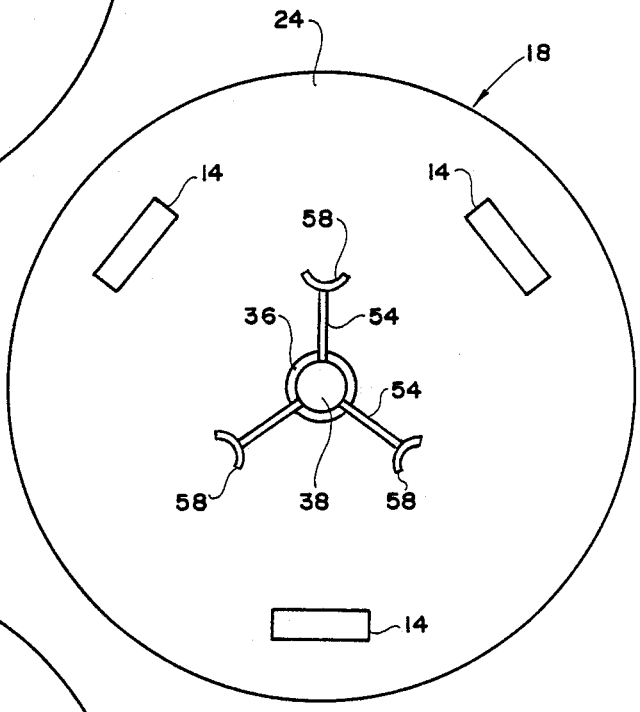
FIG. 6 is a top view of another embodiment of the shock absorbing device of the present invention.
Figure 7:
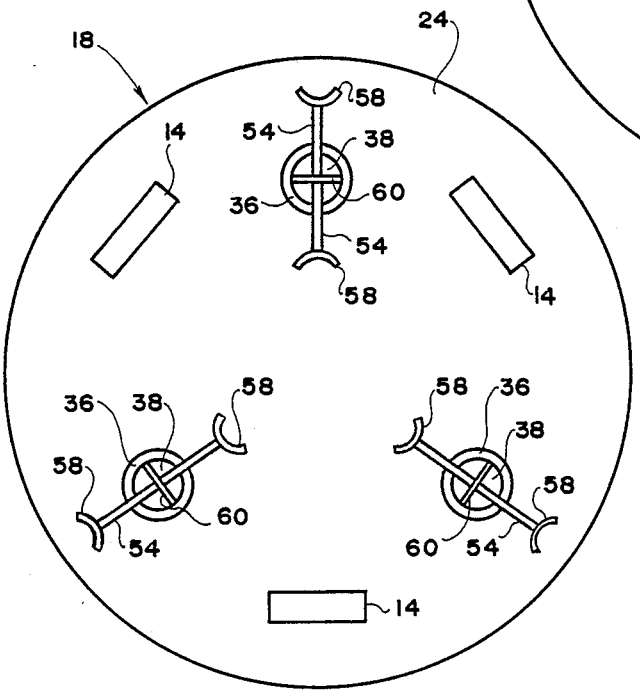
FIG. 7 is a top view of another embodiment of the shock absorbing device of the present invention.

An alternative method of stretching the flexible resilient tension members 54 is illustrated in FIG. 6, wherein the members 54 are stretched at 120° to each other extending from the piston head 38 to the staples or rings 58 equidistantly spaced from each other and from the center defined by the vertical axis of the piston means 30.

In operation, the legs 14 of an offshore jack-up rig 10 are lowered down by conventional jack-up methods, until such time as piston 30 reaches the soil, and under the weight of the footing 18 and its own weight embeds, at least to a distance, into the soil. The embedment distance is limited by the bottom surface 26 of the footing 30.

During the impact of the leg structure 14 with the soil of the ocean floor 16, the resilient members 54 allow the pistons to "bounce" to a limited degree, thus considerably absorbing the shock of the impact and preventing serious damage to the leg structure 14 and to the lowering mechanism itself.

It will be appreciated that the shock absorbing system of the present invention is provided for each leg 14 of an offshore rig, so as to allow the legs to assume their natural position in relation to the ocean floor, depending on the location, wherein the leg is placed.

It should be noted that at least one piston member 30 is used per footing 18. However, this number can be easily changed to a plurality of piston members, such as two, three or more, depending on the specific leg design.

Many modifications and changes in the shock absorbing system disclosed herein may be carried out by persons skilled in the art without departing from the spirit and scope of the present invention. I therefore pray that my rights to the invention be limited only by the scope of the appended claims.

I claim:

1. A device for absorbing vertically directed impact loads on supporting legs of an offshore structure, each of the legs resting on an individual footing, said device comprising:

an elongated piston means mounted for a limited vertical movement within an opening formed in the footing of each supporting leg;

a means for limiting the vertical movement of the piston means carried by an exterior of the piston means; and flexible resilient tension means for operatively connecting said piston means and said footing and allowing said piston means to resiliently absorb the impact of the footing with an ocean floor, said tension means comprising at least one elongated resilient tension cable fixedly attached at least at one of its ends to a top surface of the footing and connected to a top portion of the piston means, said tension cable causing at least partial embedment of the piston means in the ocean floor during contracting reaction.

2. The device of claim 1, wherein said piston means comprises at least one piston body having an upper portion extending to a distance above a top surface of the footing and a lower portion extending downwardly to a distance from a bottom surface of the footing.

3. The device of claim 2, wherein the opening extends substantially through an entire body of the footing along its vertical axis.

4. The device of claim 2, wherein said piston body carries a piston head fixedly attached to an uppermost part thereof, said piston head being provided with at least one inverted U-shaped groove formed on an exterior of the piston head and extending from one side of the piston head to its other side.

5. The device of claim 2, wherein said means for limiting the vertical movement of the piston means comprises a stopper plate fixedly attached to a piston body of said piston means in circumferential relationship thereto a distance from an uppermost part of the piston body.

6. The device of claim 5, wherein said stopper plate is formed by an annular body, an outside diameter of which is at least slightly greater than an interior diameter of the central opening formed in the footing.

7. The device of claim 4, wherein said tension means comprises at least one elongated cable engageable within at least one groove of the piston head.

8. The device of claim 7, wherein one end of said cable is securely attached to said footing a distance from the piston means, while another end of the cable is securely attached to the footing diametrically opposite from said first end.

9. The device of claim 7, wherein said piston head is provided with a plurality of substantially parallel inverted U-shaped grooves, each receiving an elongated cable in frictional engagement therein.

10. The device of claim 9, wherein each of said cables has a first end and a second end, and wherein the first ends of each cables are securely attached to the footing a distance from said piston means while the second ends of each cable are securely attached to the footing diametrically opposite said first ends.

11. The device of claim 1, wherein said piston means carries a piston head fixedly attached to its uppermost part, said piston head being provided with a plurality of inverted U-shaped grooves formed on an exterior of the piston head and extending from one side of the piston head to its other side.

12. The device of claim 11, wherein said tension means comprises a plurality of elongated cables frictionally engageable within said grooves of the piston head.

13. The device of claim 12, wherein each of said cables has a first end and a second end, and wherein the first ends are securely attached to the piston head and the second ends are securely attached to the footing equi-distantly from each other and from the piston head.

14. The device of claim 1, wherein said piston means comprises a plurality of piston bodies, each having an upper portion extending to a distance above a top surface of the footing and a lower portion extending downwardly to a distance from a bottom surface of the footing, each piston body being slidably receivable within its respective opening formed in the footing of each supporting leg.

15. The device of claim 2, wherein said piston body carries an embedment tip on a lowermost part thereof to facilitate at least partial embedment of the piston body in the ocean floor.

16. A device for absorbing vertically directed impact loads on supporting legs of an offshore structure, each of the legs engaged with a footing at its bottom end, said device comprising:

an elongated piston means comprising at least one piston body having an upper portion and a lower portion, said upper portion carrying a piston head fixedly attached thereto, and a lower portion carrying an embedment tip to facilitate at least partial embedment of the lower portion in an ocean floor, said piston body being adapted for a limited vertical movement within an opening formed along a vertical axis of the footing;

a means for limiting the vertical movement of the piston body within said opening, said movement limiting means comprising an annular stopper plate fixedly secured in circumferential relationship to an exterior of the piston body at a distance from the piston head; and a flexible resilient tension means for operatively connecting said piston means and said footing and allowing said piston means to resiliently absorb impact of the footing with the ocean floor while applying tension on the legs during attempted displacement of the legs caused by wave motions, said tension means comprising at least one elongated tension cable fixedly attached at least at one of its ends to a top surface of the footing and connected to the piston head, said tension cable causing at least partial embedment of the embedment tip in the ocean floor upon contracting reaction.

17. The device of claim 16, wherein said piston head is formed with at least one inverted U-shaped groove adapted to receive the tension means in frictional engagement therein.

18. The device of claim 17, wherein said tension means comprises at least one elongated cable having a first and being securely attached to said footing a distance from said stopper plate and the second and being securely attached to said footing diametrically opposite said first end.

19. The device of claim 16, wherein said piston head is formed with a plurality of inverted U-shaped grooves, and wherein said tension means comprises a plurality of elongated cables frictionally engageable within said grooves and securely attached to the footing at their opposite ends.

20. The device of claim 16, wherein said piston means comprises a plurality of piston bodies, each being slidably receivable within its respective opening formed in the footing of each supporting leg.

21. A method of absorbing vertically directed impact loads on supporting legs of an offshore structure, each of the legs resting on individual footing, the method comprising the steps of:

providing an elongated piston means mounted for a limited vertical movement within an opening formed in the footing of each supporting leg;

providing a means for limiting the vertical movement of the piston means carried by an exterior of the piston means;

providing a flexible resilient tension means for operatively connecting said piston means and said footing, said tension means comprising at least one elongated tension cable fixedly attached at one of its ends to a top surface of the footing and connected to a top portion of the piston means;

lowering a supporting leg to a distance adjacent an ocean floor;

allowing the elongated piston to contact the ocean floor, while resiliently absorbing the impact of the footing with the ocean floor by at least partial stretching of the tension cable, allowing the tension cable to contract and facilitate at least partial embedment of the piston means within the ocean floor.

22. The method of claim 21, wherein said piston means comprises:

at least one piston body having an upper portion and a lower portion, said upper portion carrying a piston head fixedly attached thereto, and a lower portion carrying an embedment tip to facilitate at least partial embedment of the lower portion in an ocean floor.

23. The method of claim 21, wherein said piston means comprises a plurality of piston bodies, each having an upper portion and a lower portion, said upper portion carrying a piston head operationally associated with the flexible resilient tension means.

24. The method of claim 23, wherein each of said piston bodies is slidably received within its respective opening formed in the footing of each supporting leg.

25. The method of claim 23, wherein the lower portion of each piston body is provided with an embedment tip to facilitate at least partial embedment of the lower portion in an ocean floor.

* * * * *